United States Patent [19]

Thiele

[11] 3,937,858

[45] Feb. 10, 1976

[54] METHOD OF AND BATH FOR THE PLATING OF ALUMINUM OR AN ALUMINUM ALLOY ON A METALLIC SUBSTRATE

[75] Inventor: Wolfgang Thiele, Bad Homburg, Germany

[73] Assignee: Metallgesellschaft Aktiengesellschaft, Frankfurt am Main, Germany

[22] Filed: Feb. 13, 1974

[21] Appl. No.: 441,967

[30] Foreign Application Priority Data

Feb. 20, 1973 Germany ..... 2308281

[52] U.S. Cl. ..... 427/431; 427/320; 427/436

[51] Int. Cl.[2] ..... C23C 1/00

[58] Field of Search ..... 117/114 R, 51, 52, 169 R, 117/151, 138; 427/436, 430, 431, 432, 320

[56] References Cited

UNITED STATES PATENTS

| | | | |
|---|---|---|---|
| 2,565,768 | 8/1951 | Gittings | 117/114 C |
| 3,010,190 | 11/1961 | Russell | 117/51 |
| 3,057,050 | 10/1962 | Hodge et al. | 117/114 C |
| 3,481,769 | 12/1969 | Carter | 117/114 C |

*Primary Examiner*—Ralph S. Kendall
*Assistant Examiner*—Edith R. Buffalow
*Attorney, Agent, or Firm*—Karl F. Ross; Herbert Dubno

[57] ABSTRACT

Aluminum or an aluminum alloy is plated on a metallic substrate from a bath of molten aluminum or aluminum alloy containing 0.005 to 1.0% (preferably 0.01 to 0.5%) strontium and/or 0.01 to 5.0% antimony. The metal substrate is preferably iron, steel, or a noniron metal such as copper, titanium, nickel, cobalt, chromium, tantalum, tungsten, vanadium or zirconium. The bath may also contain 1.0 to 15.0% by weight silicon and 0.005 to 1.0% beryllium.

7 Claims, No Drawings

METHOD OF AND BATH FOR THE PLATING OF ALUMINUM OR AN ALUMINUM ALLOY ON A METALLIC SUBSTRATE

FIELD OF THE INVENTION

The present invention relates to the coating of an aluminum-containing layer upon ferrous-metal and nonferrous-metal substrates and, more particularly, to the deposition of aluminum or an aluminum alloy from a molten bath upon a metallic substrate.

BACKGROUND OF THE INVENTION

It has previously been proposed to deposit aluminum or aluminum alloy on a ferrous-metal substrate by dipping the latter into a molten bath of aluminum or aluminum alloy. An advantage of the aluminum-containing coating is that it generally has a higher resistance to corrosion than zinc (the most common galvanizing metal) and also has a greater resistance to high-temperature environments than coatings of lead, zinc or tin.

However, depositing a satisfactory coating of aluminum or an aluminum alloy onto a metal substrate is not simple since the coating character is affected by the oxidic surface normally present on the bath. Other problems which arise in the coating of aluminum onto metallic substrates from a bath or melt of the metal include the contamination of the workpiece surface and the high interfacial tension even when the substrate surface is clean and the aluminum is pure.

It has been proposed heretofore to overcome these disadvantages by introducing into a molten bath of aluminum, 0.005 to 0.13% by weight of sodium or potassium when the workpiece is a ferrous metal (iron or steel) or a metal such as chromium, nickel or titanium. Under these conditions, firmly adherent and uniform surface coating of aluminum alloys cannot be obtained.

Where ferrous metals constitute the substrate, the dipping of the workpiece into a bath of molten aluminum results in the formation of a reaction zone at which iron aluminum is formed. This metallic layer is brittle and of a thickness which depends upon the duration of immergence of the substrate in the aluminum bath.

The intermetallic iron-aluminide layer may have a thickness of 50 to 150 microns and is so brittle that, upon bending of the workpiece, the intermetallic layer cracks and results in spalling of the coating layer.

To avoid this disadvantage it has been proposed to provide barrier layers, e.g. of chromium, cobalt, molybdenum, nickel or tungsten, and to permit diffusion of the barrier metal into the structure of the ferrous metal underlying the barrier. Thereafter the aluminizing treatment is carried out with a diminished tendency toward formation of iron aluminide. However, even with this system it is not possible to completely prevent iron aluminide from forming and spalling, although to a lesser degree, thereby posing a problem. Furthermore, the diffusion operation and the deposition of the bearer layer is a time-consuming treatment which seldom is economical and may not be convenient or even possible.

It has also been proposed to control the thickness of the intermetallic (iron-aluminide) layer so that the latter has a thickness of 0.05 to 0.15 mm and contains 17 to 30% by weight aluminum by depositing the aluminum from a bath which contains magnesium and/or calcium as alloying elements. These systems are also not fully satisfactory. Finally, mention may be made of systems in which aluminum-silicon alloys are deposited upon metallic substrates from baths which contain calcium, strontium or barium to alter the structure of the layer. Even these systems have not proved fully satisfactory.

OBJECTS OF THE INVENTION

It is the principal object of the present invention to provide an improved aluminum coating for ferrous and nonferrous metal which will have satisfactory structure and integrity and will be less prone to spalling than earlier aluminum or aluminum-alloy coatings.

It is another object of this invention to provide a method of forming an improved aluminum or aluminum-alloy coating on metallic substrates.

Yet another object of the invention is to provide a bath for depositing an aluminum or aluminum-alloy coating upon a metal substrate.

SUMMARY OF THE INVENTION

I have now found that the foregoing objects can be readily attained by the deposition of aluminum or an aluminum-alloy from a melt or bath thereof which contains 0.005 to 1.0% (preferably 0.01 to 0.5%) by weight strontium and/or 0.01 to 5.0% by weight antimony upon a ferrous or nonferrous metallic substrate by fire aluminization (pyroaluminization) without the disadvantages hitherto encountered. More specifically, the tendency toward spalling is reduced, the layers have substantially greater structural integrity and resistance to high temperatures and corrosion than earlier aluminum or aluminum-alloy layers, and the coating can be carried out without the difficulties hitherto encountered.

I have discovered that molten baths which consist of aluminum or aluminum alloys and strontium and/or antimony in the amounts stated preserve a bright and oxide-free surface which does not become contaminated. Apparently this is a consequence of the fact that strontium and antimony scarcely oxidize at temperatures of a bath above 800°C whereas calcium and alkali metals such as sodium readily oxidize or burn at 700°C so that additional alkali metal must be fed into the melt and considerable quantities of the oxidized metal form a dross or slag layer on the surface. Consequently, the strontium and/or antimony greatly reduce the quantities of additives introduced into the bath over what would otherwise be required.

Strontium and/or antimony, added to a molten aluminum or aluminum-alloy bath, significantly reduce the interfacial tension between the surface of the substrate and the molten bath so that the latter rapidly wets the surfaces of the substrate brought into contact with the bath.

The advantage of this reduction in interfacial tension is that the substrate need not be moved or agitated by vibration or any other special technique, nor is it necessary to heat the melt or to provide for prolonged immersion times.

When the bath consists essentially of aluminum or an aluminum alloy and strontium and/or antimony is employed, it is sufficient to operate with a bath temperature of 600° to 850°C and an immersion time of 5 to 60 seconds depending upon the mass of the substrate.

While applicant does not wish to be bonded by any theory regarding the surprising efficacy in aluminum or aluminum-alloy coating obtained by the addition of strontium and/or antimony to the melt, it appears that an unusually thin intermetallic layer of iron-aluminide is formed on ferrous-metal substrates, the layer being not in excess of 15 microns and generally between 10 and 15 microns.

Of course, other alloying elements may be added to the bath to obtain structural modification of the aluminum coating. For example, 1.0 to 15.0% silicon in the bath has been found to be highly desirable and beryllium in an amount of 0.005 to 1.0% by weight has been found to promote the effect of strontium and/or antimony, even to the point of reducing the quantities of the latter which may be required for a particular purpose.

The substrate may be composed of a ferrous metal, i.e. iron or steel, or a nonferrous metal, such as copper, titanium, cobalt, chromium, tentalum, tungsten, nickel, vanadium or zirconium or alloys of one of these metals with another or of three or more of the aforementioned metals, or alloys of the listed metals with iron.

The substrate may be in a finished (machined) or an unmachined state, e.g. in the form of sheets, wire or bars, and it has been noted that the invention is most effective when the coating is applied to thin structures of the substrate metal, e.g. thin sheet metal. For thin substrates, the immersion time may be, say, 15 seconds instead of about 1 to 3 minutes as required for massive stock of the identical steel.

According to the invention, the substrate surface is cleaned by any conventional technique, e.g. degreasing with a solvent and/or pickling, so that the surface is free from grease, dust and oxide and has been slightly etched. The substrate may be coated with layers of aluminum or aluminum-alloy in an intermittent process, e.g. by repeatedly immersing the substrate into and withdrawing it from the steel melt or by continuous techniques, e.g. passing the substrate slowly through a bath corresponding to the present invention.

The layers applied according to the present invention adhere firmly and are highly deformable, i.e. resistant to bending stress, and are uniform and nonferrous. Surprisingly, the melt of the aluminum or aluminum-alloy layer containing strontium and/or antimony according to the invention maintains substantially constant chemical composition for prolonged periods because the strontium and antimony do not burn out and are deposited concurrently with the aluminum or aluminum alloy. The bath remains free of dross or slag layers and, as noted, relatively short immersion time and low immersion temperatures can be used, so that the substrates can even be articles having a precipitation-hardened structure which is not adversely affected.

The pyroaluminized materials produced according to the invention may be used as starting materials for making equipment or other structures designed to resist high temperatures, oxidation and corrosion including exhaust mufflers and pipes of internal combustion engines, the grates of chemical roasting plants or internal elements such as wires in electrostatic precipitators. Because of its high reflection, the coating layer may be used in reflectors of electric household appliances such as radiant heaters or toasters.

SPECIFIC EXAMPLES

Example I a. A section of a 0.5 millimeter thick strip of commercial carbon steel was first degreased in ethylene perchloride vapor, then pickled in dilute hydrochloric acid and thereafter rinsed in hot water and dried.

The immersion bath consisted of an aluminum alloy which contained 5% silicon and had an initial weight of 5 kilograms. The bath was at a temperature of 720°C. The sheet steel was quickly dipped under the surface of the molten bath in order to avoid an oxidation of the surface of the steel. After an immersion bath of 10 seconds, the sheet metal specimen was withdrawn from the molten aluminum. Parts of the sheet steel had not yet been completely coated with aluminum. A second sheet steel element was rapidly dipped into the molten Al and Si bath and was then continually moved in the bath to ensure a good wetting of the sheet metal with the molten material. After an immersion in the molten bath of AlSi for 10 seconds, the sheet metal was withdrawn from the molten material and still exhibited individual uncoated areas. An uninterrupted layer of dip-coated aluminum was formed only when the sheet steel had been immersed for a longer time of about 30 seconds and had been constantly moved during this time. The resulting intermetallic layer of $Fe_xAl_y$ had a thickness of 40 micrometers.

b. In another experiment, 0.2% sodium as an additional alloying element was admixed with the immersion bath of an aluminum alloy containing 5% Si of a gray-blue oxide skin formed on the initially bright surface of the molten bath. To eliminate the risk of a formation of faults on the dipped articles as a result of this oxide skin, the oxide was removed from the surface of the molten bath immediately before the sheet steel was dipped. After an immersion time of ten seconds, the sheet steel was removed from the molten aluminum and cooled. The aluminum coating had a dull blue-gray surface and exhibited some adhered oxide particularly on the side where the steel strip had entered the molten aluminum first. At these points, the aluminum coating could easily be peeled off by hand. The microscopic examination of the steel specimen showed that an $Fe_xAl_y$ alloy interlayer in a thickness of 30 microns had formed during the immersion in the molten aluminum. About 30 minutes after the addition of sodium, such a large amount of sodium had burnt out that the sodium content of the molten bath of Al and Si had decreased below 0.001%.

c. For another experiment, a new molten bath of aluminum and 5% Si was prepared and 0.1% strontium was added as a second alloying element instead of sodium. The steel was pretreated as in the preceding experiments. The surface of the molten bath of aluminum had not lost its silver-bright appearance as a result of the addition of strontium. The steel specimen which had been removed from the immersion bath after ten seconds had a silver-bright, nonporous coating of aluminum. Microscopic examination showed that the interlayer of $Fe_xAl_y$ had an average thickness of 15 microns. By the chemical analysis of the immersion bath it was found that even after an operation for more than 8 hours the strontium content of the immersion bath had decreased only by about 10% of the initial strontium content. In this case, a realloying with the additive element was not required whereas such realloying of the sodium-containing immersion baths was required already after 20 to 30 minutes.

EXAMPLE II

The article to be dipped consisted of a 0.5 millimeter thick sheet steel having the same composition as that used in Example I. The steel was pretreated as in Example I. Experiments were conducted to compare the results obtained with the following molten immersion baths of aluminum, each of which was used in an initial amount of 5 kilograms.

a. Al, 12.5% Si
b. Al, 12.5% Si, 0.2% Na
c. Al, 12.5%, Si, 0.5% Sb

Compared to Example I, the eutectic alloys used as immersion baths permitted the use of the immersion bath at a lower temperature of 680°C.

Just as in Example I, the binary immersion bath (a) required a longer immersion time of at least 30 seconds compared to immersion baths (b) and (c) and a continual movement of the dipped article in the molten bath of Al and Si in order to ensure a good wetting of the sheet steel with the molten material and the formation of an uninterrupted aluminum layer by dip coating. The resulting $Fe_xAl_y$ formed by the reaction had an average thickness of 35 microns and was much thicker than said interlayer formed in the immersion baths which contained sodium (about 25 microns) and antimony (about 15 microns), in which only an immersion time of 10 seconds was required. Must as in Example I, the immersion bath which contained antimony had the advantage that there was not a tendency to oxidize and burn out. After 20–30 minutes, so much of the added sodium had burnt out that the immersion bath then showed the same behavior as the molten bath (a).

EXAMPLE III

Sheet steel specimens having a thickness of 0.4 millimeter and containing 18% Cr and 8% Ni were dipped into the following molten baths of Al and Si, which were used in an initial weight of 5 kilograms:

d. 7 Si 0.2 Na aluminum alloy
e. 7 Si 0.1 Sr aluminum alloy.

Where a temperature of about 700°C was selected for the immersion bath, the immersion time in the Sr-containing alloy (e) could be reduced to 5 seconds whereas an immersion for this time in the sodium-containing alloy (d) did not result in a completely covering, faultless aluminum coating. The average thickness of the $Fe_xAl_y$ interlayer under the Sr-containing Al and Si coating was only 10 micrometers. Another disadvantage of the sodium-containing immersion bath was the rapid burn-out of the sodium.

EXAMPLE IV

All oxide and grease were removed from round bars which were 15 millimeters in diameter and which consisted of a 6a14V titanium alloy. The bars were then immersed into molten baths consisting of 99.5% aluminum and the following admixtures:

f. 0.2% Na
g. 0.1% Sr.

In case of a temperature of 730°C of the sodium bath and an immersion time of 2 minutes, the immersion in the Sr-containing alloy resulted as in all preceding examples in such brighter and, above all, faultless aluminum coatings compared to the sodium-containing alloy (f). In neither of these two cases was a reaction zone between titanium and the aluminum coating apparent in a microscopic examination.

EXAMPLE V

All oxide and grease was removed from nickel bars 15 millimeters in diameter, and the bars were then dipped for two minutes into one or the other of the two molten baths of pure aluminum used also in Example IV and at 730°C. As regards the surface appearance and the presence of faults on the aluminum coating, the results were the same as in Example IV. the $Ni_xAl_y$ interlayer formed by the reaction had an average thickness of 20 microns.

The following tables indicate the compositions of the immersion baths of aluminum (Table I) and the properties (Table II) of the coatings made from said baths on different substrates.

Table I

Composition of Immersion Baths of Aluminum Alloying Elements in Percent by Weight

| Number | Si | Be | Sr | Sb | Na |
|---|---|---|---|---|---|
| 1 | 5 | — | — | — | — |
| 2 | 5 | — | — | — | 0.2 +) |
| 3 | 5 | — | 0.1 | — | — |
| 4 | 12.5 | — | — | — | — |
| 5 | 12.5 | — | — | — | 0.2 +) |
| 6 | 12.5 | — | — | 0.5 | — |
| 7 | 7 | — | — | — | 0.2 +) |
| 8 | 7 | — | 0.1 | — | — |
| 9 | — | — | — | — | 0.2 +) |
| 10 | — | — | 0.1 | — | — |
| 11 | 5 | — | 0.1 | 0.5 | — |
| 12 | — | 0.7 | 0.1 | — | — |
| 13 | — | 0.7 | — | 0.5 | — |
| 14 | — | 0.7 | 0.1 | 0.5 | — |

Note:
+) 30 minutes after the addition of sodium, it is ineffective because it has been burnt out except for a remainder of about 0.001% Na.

Table II

Properties of Dip-coated Aluminum Layers of Various Compositions

| Alloy Number | Immersion Time sec. | Thickness of $Fe_xAl_y$ Layer microns | Surface of Al Coating | Tendency to Spall | Bending Test Cracks++) Size | Bending Test Cracks++) Number |
|---|---|---|---|---|---|---|
| Example I | | (Substrate S; Bath Temperature 720°C): | | | | |
| 1 | 10+) | ii | s | appr. | smaller | equal |
| 1 | 20+) | ii | s | appr. | smaller | equal |
| 1 | 30+) | 46 | s | appr. | smaller | larger |
| 2 | 10 | ii | m | i.o.d. | smaller | equal |
| 2 | 20 | 30 | m | i.o.d. | smaller | equal |
| 3 | 10 | 15 | s | none | none | none |
| Example II | | (Substrate S; Bath Temperature 680°C): | | | | |
| 4 | 10+) | ii | s | small | smaller | smaller |
| 4 | 20+) | ii | s | small | smaller | smaller |
| 4 | 30+) | 35 | s | small | smaller | equal |
| 5 | 10 | ii | m | i.o.d. | smaller | equal |
| 5 | 20 | 25 | m | i.o.d. | smaller | equal |
| 6 | 10 | 15 | s | none | none | none |
| Example III | | (Substrate E; Bath Temperature 700°C): | | | | |
| 7 | 5 | ii | m | i.o.d. | smaller | equal |
| 8 | 5 | 10 | s | none | none | none |
| Example IV | | (Substrate T; Bath Temperature 730°C): | | | | |
| 9 | 120 | 0 | m | i.o.d. | equal | equal |
| 10 | 120 | 0 | s | none | none | none |
| Example V | | (Substrate N; Bath Temperature 730°C): | | | | |
| 9 | 120 | 20 | m | i.o.d. | equal | equal |
| 10 | 120 | 19 | s | none | none | none |

Table II-continued

| Alloy Number | Immersion Time sec. | Thickness of $Fe_xAl_y$ Layer microns | Surface of Al Coating | Tendency to Spall | Bending Test Cracks[++] Size | Bending Test Cracks[++] Number |
|---|---|---|---|---|---|---|
| (Substrate S; Bath Temperature 720°C): | | | | | | |
| 11 | 10 | 17 | s | none | none | none |
| (Substrate S; Bath Temperature 730°C): | | | | | | |
| 12 | 10 | 15 | s | none | none | none |
| 13 | 10 | 16 | s | none | none | none |
| 14 | 10 | 12 | s | none | none | none |

Properties of Dip-coated Aluminum Layers of Various Compositions

[+] Immersed article is constantly moved up and down in immersion bath
[++] Compared to coatings of pure aluminum;
S 0.5 millimeter thick sheet of commercial carbon steel;
E 0.4 millimeter thick sheet of 18Cr8Ni steel;
T Bar of 16A14V titanium alloy, 15 millimeters in diameter
N Nickel bar 15 millimeters in diameter;
i.i. Partly interrupted $Fe_xAl_y$ layer of irregular thickness;
m Duller in appearance than pure aluminum coatings;
s Silver-bright appearance;
appr. appreciable;
i.o.d. increased oxide deposits.

I claim:

1. A hot dip method of producing an aluminum-alloy coating comprising the steps of immersing a metallic substrate into a bath of molten aluminum-alloy consisting essentially of 0.005 to 1.0% by weight of strontium and/or 0.01 to 5.0% by weight antimony balance aluminum and metallic impurities due to the producing process, for a period sufficient to deposit an aluminum-alloy coating on said substrate.

2. The method defined in claim 1 wherein said bath contains 1.0 to 15% by weight silicon.

3. The method defined in claim 1 wherein said bath contains 0.1 to 0.05% by weight strontium.

4. The method defined in claim 1 wherein said substrate consists of ferrous metal or a metal selected from the group which consists of copper, titanium, nickel, cobalt, chromium, tantalum, tungsten, vanadium and zirconium and alloys thereof with each other and with iron.

5. The method as defined in claim 1 wherein said substrate is immersed in said bath for a period ranging from 5 seconds to 3 minutes and said bath is at a temperature of 600° to 850°C.

6. The method defined in claim 1 wherein said substrate is immersed in said bath for a period ranging from 15 to 60 seconds and said bath is at a temperature of 600° to 850°C.

7. A method of producing an aluminum or aluminum-alloy coating comprising the steps of immersing a metallic substrate into a bath of molten aluminum or aluminum-alloy consisting essentially of:

0.005% to 1.0% Sr by weight, and/or
0.01% to 5.0% Sb
up to 15% Si
up to 1% Be; and
balance aluminum, for a period sufficient to deposit an aluminum or aluminum-alloy coating on said substrate.

* * * * *